US008937259B2

(12) United States Patent
Garvin et al.

(10) Patent No.: US 8,937,259 B2
(45) Date of Patent: Jan. 20, 2015

(54) UNIVERSAL ELECTRICAL CIRCUIT BREAKER LOCKING DEVICE

(71) Applicants: Barton L. Garvin, Western Springs, IL (US); Walter Ejsmont, Lemont, IL (US)

(72) Inventors: Barton L. Garvin, Western Springs, IL (US); Walter Ejsmont, Lemont, IL (US)

( * ) Notice: Subject to any disclaimer, the term of this patent is extended or adjusted under 35 U.S.C. 154(b) by 0 days.

(21) Appl. No.: 13/765,571

(22) Filed: Feb. 12, 2013

(65) Prior Publication Data

US 2013/0220780 A1 Aug. 29, 2013

Related U.S. Application Data

(63) Continuation-in-part of application No. 12/902,069, filed on Oct. 11, 2010, now Pat. No. 8,598,477.

(60) Provisional application No. 61/251,195, filed on Oct. 13, 2009.

(51) Int. Cl.
*H01H 3/20* (2006.01)
*H01H 9/28* (2006.01)

(52) U.S. Cl.
CPC ..... *H01H 9/286* (2013.01); *H01H 9/287* (2013.01); *H01H 9/283* (2013.01)
USPC ..... 200/43.21

(58) Field of Classification Search
USPC ..... 200/43.21, 43.01, 43.11–43.22
See application file for complete search history.

(56) References Cited

U.S. PATENT DOCUMENTS

| | | | | |
|---|---|---|---|---|
| 3,610,849 | A | 10/1971 | Lehman et al. | 200/42 |
| 3,624,321 | A | 11/1971 | Puetz et al. | 200/42 |
| 3,723,677 | A | 3/1973 | Arias | 200/44 |
| 3,816,677 | A | 6/1974 | Soltez | 200/42 |
| 3,898,398 | A | 8/1975 | Borst et al. | 200/44 |
| 3,959,609 | A | 5/1976 | Laing et al. | 200/4 |
| 3,982,082 | A | 9/1976 | Thorud et al. | 200/44 |
| 4,079,214 | A | 3/1978 | Castonguay et al. | 200/50 |
| 4,187,420 | A | 2/1980 | Piber | 200/321 |
| 4,292,483 | A | 9/1981 | Roytberg | 200/42 |
| 4,347,412 | A | 8/1982 | Mihara et al. | 200/42 |
| 4,435,624 | A | 3/1984 | Sepulveda | 200/42 |
| 4,467,152 | A | 8/1984 | Gordy | 200/42 |
| 4,623,765 | A | 11/1986 | Leyden | 200/43.22 |
| 4,820,887 | A | 4/1989 | Schmitz | 200/43.18 |
| 5,079,390 | A | 1/1992 | Costanzo et al. | 200/43.14 |
| 5,120,236 | A | 6/1992 | Gilbert | 439/133 |
| 5,147,991 | A | 9/1992 | Jordan, Sr. | 200/43.14 |
| 5,165,528 | A | 11/1992 | Kozlowski et al. | 200/43.15 |
| 5,181,602 | A | 1/1993 | Kozlowski et al. | 200/43.015 |
| 5,219,066 | A | 6/1993 | Jameson | 200/42.01 |
| 5,260,528 | A | 11/1993 | Benda | 200/43.14 |

(Continued)

*Primary Examiner* — Renee S Luebke
*Assistant Examiner* — Lheiren Mae A Caroc
(74) *Attorney, Agent, or Firm* — David G. Rosenbaum; J. Peter Paredes; Rosenbaum IP, P.C.

(57) ABSTRACT

A universal breaker lock device for a switch handle includes a channel adapted to accommodate the switch handle. The channel includes a base wall, first and second side walls that extend generally perpendicularly from the base wall, and first and second feet that extend toward one another from distal ends of the first and second side walls. The channel includes a width defined by a distance measured between the first and second side walls. A lever arm extends from the base wall a distance greater than the width of the channel. A cover, with two apertures, is disposed on the lever arm, to prevent engagement with a fastener. A lock may be disposed through the apertures to prevent removal of the universal breaker lock device while in use.

20 Claims, 8 Drawing Sheets

(56) References Cited

U.S. PATENT DOCUMENTS

| | | | | |
|---|---|---|---|---|
| 5,293,011 | A | 3/1994 | Mokert | 200/43.14 |
| 5,310,969 | A | 5/1994 | Turek et al. | 200/43.14 |
| 5,322,980 | A | 6/1994 | Benda | 200/43.014 |
| 5,432,308 | A | 7/1995 | Howie, Jr. | 200/43.14 |
| 5,440,089 | A | 8/1995 | Prokop | 200/321 |
| 5,463,196 | A | 10/1995 | Darimont | 200/43.16 |
| 5,467,622 | A | 11/1995 | Becker et al. | 70/203 |
| 5,473,127 | A | 12/1995 | Falcon et al. | 200/43.04 |
| 5,477,016 | A | 12/1995 | Baginski et al. | 200/43.11 |
| 5,504,284 | A | 4/1996 | Lazareth et al. | 200/50 |
| 5,521,344 | A | 5/1996 | De Leo | 200/43.14 |
| 5,543,593 | A | 8/1996 | Turek | 200/43.11 |
| 5,558,209 | A | 9/1996 | Mohsen | 200/43.22 |
| 5,577,599 | A | 11/1996 | Turek et al. | 200/43.14 |
| 5,593,020 | A | 1/1997 | Alexander | 200/43.14 |
| 5,731,763 | A | 3/1998 | Herweck et al. | 340/825.69 |
| 5,732,575 | A | 3/1998 | Kaveney | 70/2 |
| 5,732,815 | A | 3/1998 | Brouwer | 200/43.14 |
| 5,817,998 | A | 10/1998 | Siebels et al. | 200/43.14 |
| 5,817,999 | A | 10/1998 | Mugan et al. | 200/50.11 |
| 5,868,242 | A | 2/1999 | Hall et al. | 200/43.14 |
| 5,886,426 | A | 3/1999 | Kim | 307/142 |
| 5,900,600 | A | 5/1999 | Alexander et al. | 200/43.14 |
| 5,969,312 | A | 10/1999 | Svetlik et al. | 200/61.85 |
| 6,049,045 | A | 4/2000 | Becker et al. | 200/51 |
| 6,057,518 | A | 5/2000 | Bascom et al. | 200/43.17 |
| 6,118,088 | A | 9/2000 | Thielman | 200/43.16 |
| 6,122,944 | A | 9/2000 | Chandra et al. | 70/388 |
| 6,160,227 | A | 12/2000 | Singer | 200/43.14 |
| 6,266,231 | B1 | 7/2001 | Donahue et al. | 361/631 |
| 6,288,350 | B1 | 9/2001 | Campbell et al. | 200/321 |
| 6,340,802 | B1 | 1/2002 | Bascom et al. | 200/43.17 |
| 6,371,516 | B1 | 4/2002 | Miyagawa | 280/735 |
| 6,396,008 | B1 | 5/2002 | Maloney et al. | 200/43.14 |
| 6,437,261 | B1 | 8/2002 | Bryant et al. | 200/43.16 |
| 6,469,264 | B2 | 10/2002 | Benda | 200/43.14 |
| 6,512,188 | B2 | 1/2003 | Campbell et al. | 200/321 |
| 6,538,218 | B2 | 3/2003 | Bascom et al. | 200/43.17 |
| 6,596,952 | B1 | 7/2003 | Degrazia et al. | 200/330 |
| 6,617,532 | B1 | 9/2003 | Turek | 200/43.14 |
| 6,696,651 | B1 | 2/2004 | Koopmeiners et al. | 200/43.14 |
| 6,734,379 | B1 | 5/2004 | Savadian et al. | 200/41.01 |
| 6,753,490 | B2 | 6/2004 | Svetlik et al. | 200/321 |
| 6,759,609 | B1 | 7/2004 | Henderson et al. | 200/43.11 |
| 6,844,512 | B2 | 1/2005 | Benda | 200/43.14 |
| 6,855,895 | B2 | 2/2005 | Santa Cruz et al. | 200/43.11 |
| 6,861,598 | B2 | 3/2005 | Bascom et al. | 200/43.17 |
| 6,872,898 | B2 | 3/2005 | Mohtasham | 200/43.01 |
| 6,949,711 | B1 | 9/2005 | Litteer | 200/43.01 |
| 6,963,037 | B1 | 11/2005 | Bennett et al. | 200/43.22 |
| 6,989,499 | B2 | 1/2006 | Bortolloni et al. | 200/50.05 |
| 7,137,178 | B1 | 11/2006 | Daume et al. | 24/633 |
| 7,148,435 | B2 | 12/2006 | Lau et al. | 200/43.14 |
| 7,223,927 | B2 | 5/2007 | Poyner | 200/43.04 |
| 7,227,079 | B2 | 6/2007 | Noest et al. | 174/50 |
| 7,262,376 | B2 * | 8/2007 | Brojanac et al. | 200/43.14 |
| 7,348,504 | B2 | 3/2008 | Brojanac | 200/43.22 |
| 7,371,980 | B2 | 5/2008 | Marshall | 200/43.11 |
| 7,442,888 | B2 | 10/2008 | Puddicombe, II et al. | 200/43.04 |
| 7,501,593 | B2 | 3/2009 | Brojanac | 200/43.14 |
| 7,551,047 | B2 | 6/2009 | Sokolow et al. | 335/6 |
| 7,681,421 | B2 | 3/2010 | Cannon | 70/14 |
| 7,868,719 | B2 | 1/2011 | Bazayev et al. | 335/18 |
| 7,928,330 | B2 | 4/2011 | Poyner et al. | 200/43.07 |
| 7,977,590 | B2 | 7/2011 | Brojanac | 200/43.14 |
| 2002/0056618 | A1 | 5/2002 | Bascom et al. | 200/43.17 |
| 2002/0100666 | A1 | 8/2002 | Benda | 200/43.14 |
| 2002/0139646 | A1 | 10/2002 | Karlicek | 200/43.14 |
| 2003/0098221 | A1 | 5/2003 | Bhusri et al. | 200/43.01 |
| 2003/0136652 | A1 | 7/2003 | Bascom et al. | 200/43.17 |
| 2004/0069602 | A1 | 4/2004 | Mohtasham | 200/43.01 |
| 2004/0251116 | A1 | 12/2004 | Cruz et al. | 200/43.11 |
| 2006/0151306 | A1 | 7/2006 | Lau et al. | 200/43.14 |
| 2006/0266631 | A1 | 11/2006 | Kalous et al. | 200/43.14 |
| 2006/0278504 | A1 | 12/2006 | Brojanac | 200/43.01 |
| 2007/0039806 | A1 | 2/2007 | Puddicombe, II et al. | 200/43.04 |
| 2007/0084705 | A1 | 4/2007 | Marshall | 200/43.11 |
| 2007/0163863 | A1 | 7/2007 | Mitchell et al. | 200/43.04 |
| 2007/0187216 | A1 | 8/2007 | McCoy | 200/43.13 |
| 2007/0235300 | A1 | 10/2007 | Germain et al. | 200/43.02 |
| 2007/0284228 | A1 | 12/2007 | McCoy | 200/43.01 |
| 2007/0289850 | A1 | 12/2007 | McCoy | 200/43.01 |
| 2007/0289851 | A1 | 12/2007 | McCoy | 200/43.01 |
| 2007/0289852 | A1 | 12/2007 | McCoy | 200/43.01 |
| 2008/0067043 | A1 | 3/2008 | Brojanac | 200/43.16 |
| 2008/0078658 | A1 | 4/2008 | Poyner et al. | 200/43.07 |
| 2008/0081494 | A1 | 4/2008 | Larsen et al. | 439/134 |
| 2008/0105521 | A1 | 5/2008 | Marshall | 200/43.15 |
| 2008/0142343 | A1 | 6/2008 | Manz | 200/43.11 |
| 2009/0045037 | A1 | 2/2009 | Poyner | 200/43.11 |
| 2009/0205934 | A1 | 8/2009 | Brojanac | 200/43.14 |
| 2009/0219118 | A1 | 9/2009 | Anderson | 200/43.11 |
| 2010/0133074 | A1 | 6/2010 | Eppe et al. | 200/43.16 |
| 2010/0276261 | A1 | 11/2010 | Mittu et al. | 200/43.14 |

* cited by examiner

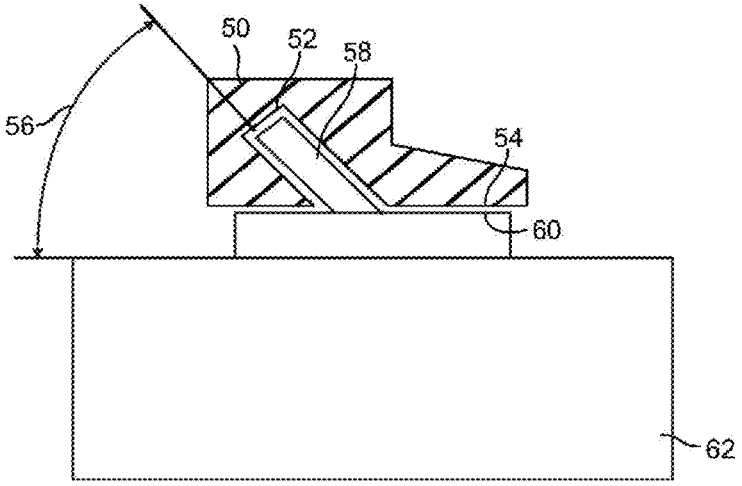
FIG. 1 – Prior Art
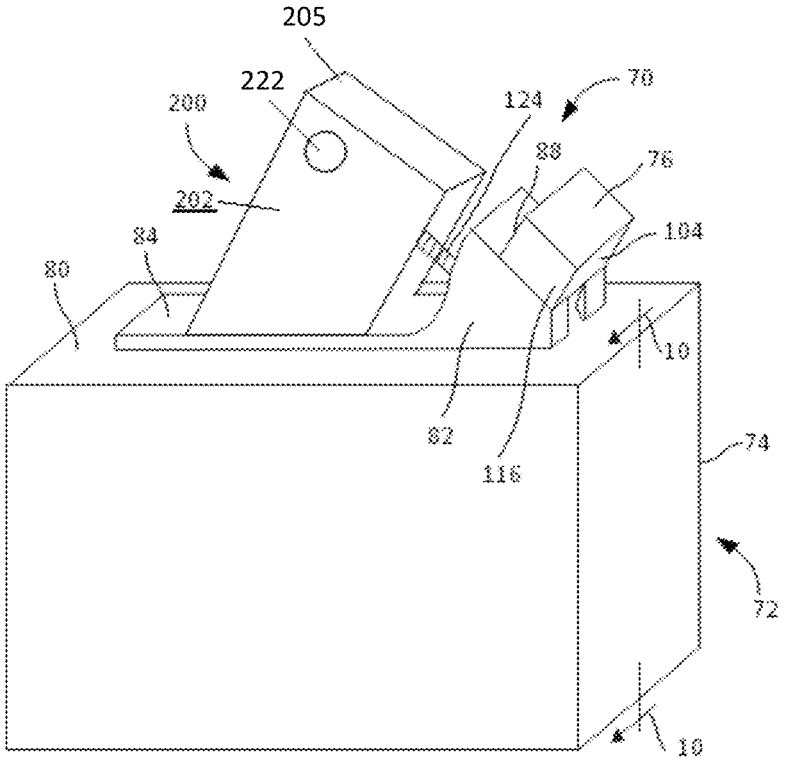
FIG. 2

UNIVERSAL ELECTRICAL CIRCUIT BREAKER LOCKING DEVICE

CROSS-REFERENCE TO RELATED APPLICATIONS

This application is a continuation-in-part application of co-pending, commonly owned U.S. patent application Ser. No. 12/902,069, filed Oct. 11, 2010, which claims priority to U.S. Provisional Patent Application Ser. No. 61/251,195, filed Oct. 13, 2009, each of which is hereby incorporated by reference in their entirety.

BACKGROUND OF THE INVENTION

In some circumstances it may be necessary to restrain a switch from being turned on or off. For example, rules promulgated by the Occupational Safety and Health Administration (OHSA) require an electrical circuit breaker to be "locked-out," i.e., restrained from being switched from an off position to an on position, for safety purposes to allow an individual to repair or install electrical equipment powered via the circuit breaker.

Manufacturers of electrical circuit breakers have developed a variety of devices for restraining individual circuit breaker switches. One such device disclosed in U.S. Pat. No. 4,347,412 is illustrated herein in FIG. 1. An inclined groove 52 extends into a surface 54 of the restraint device 50 at an angle 56 and accommodates a switch handle 58. When the restraint device 50 is mounted on the switch handle 58 the inclined groove 52 engages the switch handle 58 and the surface 54 engages a surface 60 of a switch housing 62, thereby inhibiting the switch handle 58 from moving relative to the switch housing 62.

Manufacturers may design the housing and switch handle of a circuit breaker switch such that only their respective restraint devices can interface therewith. For example, the housing may have a lip, groove, or ridge at a fixed distance from the switch handle such that the manufacturer's restraint device may be compatible with the circuit breaker switch, but restraint devices produced by competing manufacturers may not. A risk exists that an individual may place an incompatible restraint device on a circuit breaker resulting in failure of the restraint device and potential injury to the individual. Another problem with available switch restraint devices is their bulkiness. U.S. Pat. Nos. 5,079,390 and 5,147,991 each disclose a circuit breaker restraint device having a member whose width is equal to that of a switch handle. The large size of these restraint devices requires a significant amount of material and raises the cost of the restraint device. Moreover, the size of such devices may impede the ability of a user to close the outer door to the circuit breaker box. A need, therefore, exists for a universal switch restraint device that can be used without modification with a multiplicity of brands of circuit breakers.

SUMMARY OF THE INVENTION

The present invention relates to the field of electrical systems and repairs thereof. In particular, the present invention relates to a device that can be secured to a switch handle to inhibit the handle from moving relative to the switch.

In one aspect of the invention, a universal breaker lock device for a switch handle that projects through an aperture in a switch housing is presented. The universal breaker lock device comprises a collar member forming a channel therethrough and adapted to engage the switch handle. A blocking member extends from the collar member and is configured to contact the switch housing external to the aperture when the collar member engages the switch handle. A cover member is attached to the blocking member, and has open ends. The cover member further includes a pair of apertures disposed opposite each other. A lock can be disposed through the pair of apertures.

In another aspect of the invention, a universal breaker lock device for a switch handle is presented. The universal breaker lock device comprises a channel adapted to accommodate the switch handle and having first and second planar ends. A lever arm extends from the channel a distance greater than the greatest dimension measured transversely across the channel. A cover member is attached to the lever arm, and has open ends. The cover member further includes a pair of apertures disposed opposite each other. A lock can be disposed through the pair of apertures.

In a further aspect of the invention, a universal breaker lock device for a switch handle is presented. The universal breaker lock device comprises a channel adapted to accommodate the switch handle. The channel includes a base wall, first and second side walls that extend generally perpendicularly from the base wall, and first and second feet that extend toward one another from distal ends of the first and second side walls. The channel includes a width defined by a distance measured between the first and second side walls. A lever arm extends from the base wall a distance greater than the width of the channel. A cover member is attached to the lever arm, and has open ends. The cover member may further include a structure that facilitates addition of an external locking device, such as a keyed or combination lock, to the cover member to further limit access for removal of the breaker lock device. For example, a pair of apertures disposed opposite each other may be provided to permit the hasp of a lock to pass through the apertures and lock the cover to prevent removal of the breaker lock device from the circuit breaker.

BRIEF DESCRIPTION OF THE DRAWINGS

FIG. 1 is cross-sectional view of a restraint device disclosed in the prior art.

FIG. 2 is an isometric view of an embodiment of a universal breaker lock device engaging an electrical circuit breaker switch.

Other aspects and advantages of the present invention will become apparent upon consideration of the following detailed description, wherein similar structures have similar reference numerals.

DETAILED DESCRIPTION OF THE PREFERRED EMBODIMENTS

Figure 8:
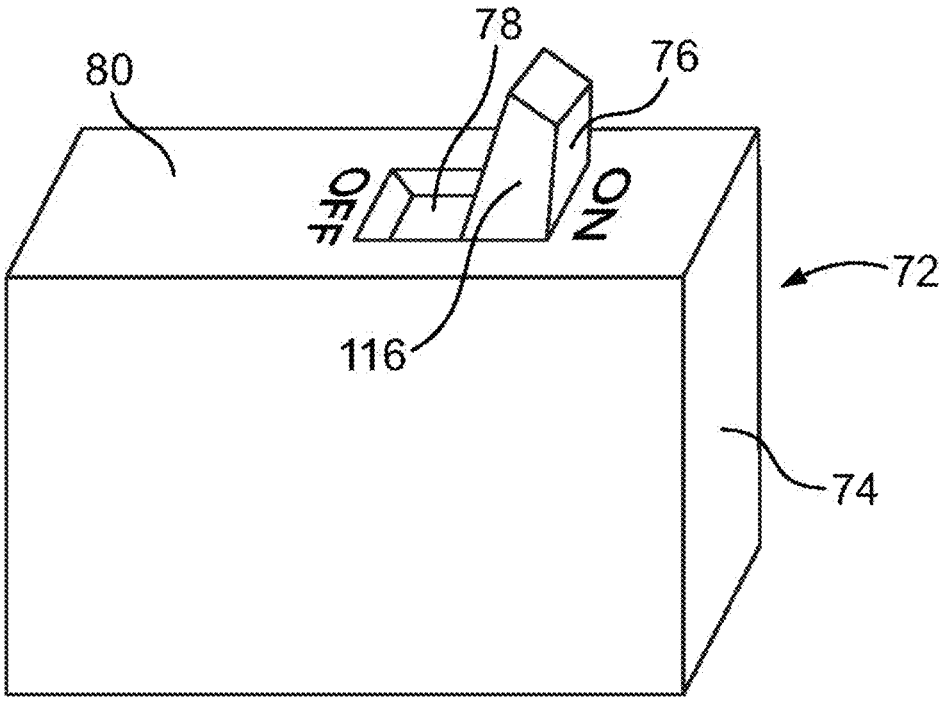
FIG. 8 is an isometric view of a conventional electrical circuit breaker switch.

Referring to FIG. 2, in one embodiment of the present invention, a universal breaker lock device 70 engages an electrical switch 72 that includes a switch housing 74 and a switch handle 76. The switch handle 76 extends through an aperture 78 (FIG. 8) disposed through a switch panel 80 on a side of the switch housing 74. The switch panel 80 may have any shape as known in the art, for example, the switch panel 80 may have a generally rectangular planar shape, as illustrated in FIGS. 2 and 8. In operation, the electrical switch 72 may be inserted into a circuit breaker board (not shown) such that only the switch panel 80 is exposed. The switch handle 76 is adapted to be moved by a user between ON and OFF positions (see FIG. 8). Movement of the switch handle 76 between the ON and OFF positions may consist of either rotation and/or translation relative to the switch housing 74.

Referring now to FIGS. 2-5, the universal breaker lock device 70 includes a collar member 82 adapted to receive the switch handle 76 such that it substantially or wholly surrounds at least a portion of the switch handle 76 when deployed. The universal breaker lock device 70 further includes a blocking member or lever arm 84 attached to the collar member 82. The blocking member 84 may be integral with the collar member 82 or may be manufactured as a separate component and subsequently attached to the collar member 82 using any common method of attachment as known in the art, including, without limitation, by welding or use of fasteners directly connecting the two components, one to the other, or indirectly by attachment of each to a single bracket. The universal breaker lock device 70 may be manufactured from any suitable material conventionally used to make fasteners, such as, without limitation intended, steel, stainless steel, copper, aluminum alloy, polyethylene, polyvinyl chloride, and polypropylene. A non-conducting material may be used to form the universal breaker lock device 70 in order to reduce the risk of electrical shock. The material usefully employed for the fasteners is suitable to the extent that it exhibits similar integrity and strength as are associated with the above-identified materials. The universal breaker lock device 70 further includes a cover member 200, which is attached to the blocking member 84 and has open ends. The cover member 200 has side walls with outer surfaces 201, 202 and inner surfaces 203, 204. The cover member 200 also has top surface 205. In some embodiments, the cover member may further include a structure that facilitates addition of an external locking device, such as a keyed or combination lock, to the cover member to further limit access for removal of the breaker lock device. As illustrated in FIG. 2, the cover member 200 further includes a pair of apertures 221, 222 disposed opposite each other. The apertures are disposed through the cover member side wall outer surfaces 201, 202 and inner surfaces 203, 204. The hasp of a lock of suitable size can be disposed through both apertures 220, 221. When the hasp of the lock is disposed through both apertures 220, 221, adjustment of the fastening means 124 is prevented (see FIG. 9). This serves to prevent accidental or intentional adjustments of the fastening means 124 resulting in an undesired removal of the universal breaker lock device 70, thereby permitting an undesired change in the setting of the switch handle 76.

Figure 4:
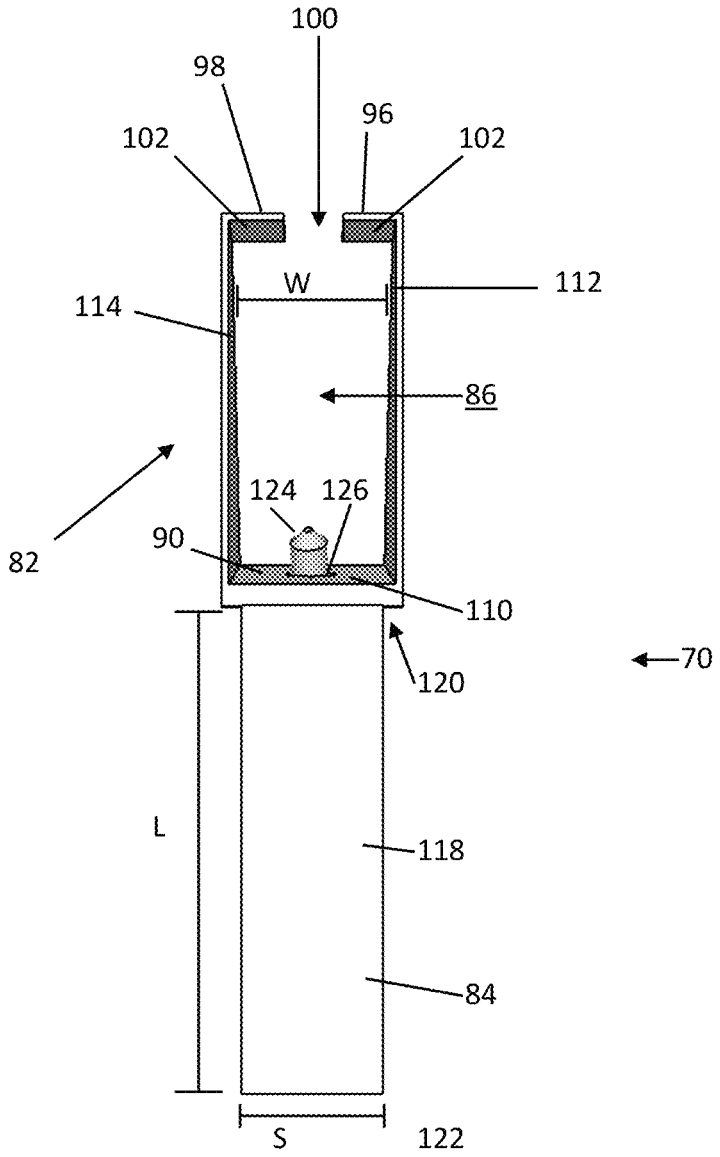
FIG. 4 is a bottom elevational view of the universal electrical circuit breaker lock device of FIG. 2.
Figure 5:
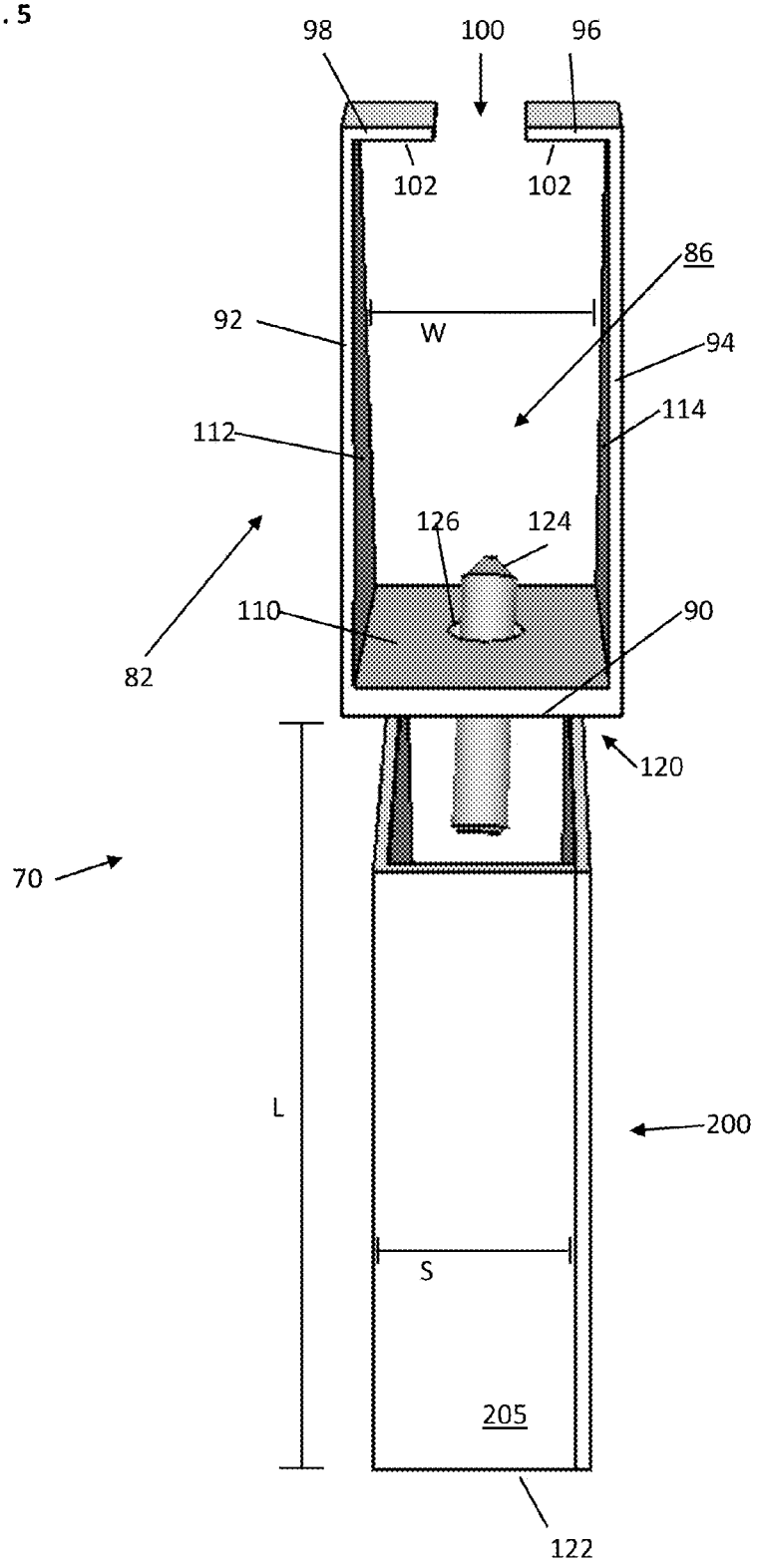
FIG. 5 is a top elevational view of the universal electrical circuit breaker lock device of FIG. 2.

Referring to FIGS. 4 and 5, the collar member 82 defines a passage or channel 86 through which the switch handle 76 protrudes when the universal breaker lock device 70 engages the electrical switch 72. The collar member 82 may surround the perimeter of the switch handle 76 wholly (not shown) or leave a portion of the surface 88 of the switch handle 76 exposed as shown in FIG. 2. Yet further alternative embodiments of the collar member 82 expose additional amounts of the perimeter of the switch handle 76 on one of more sides thereof.

Figure 6:
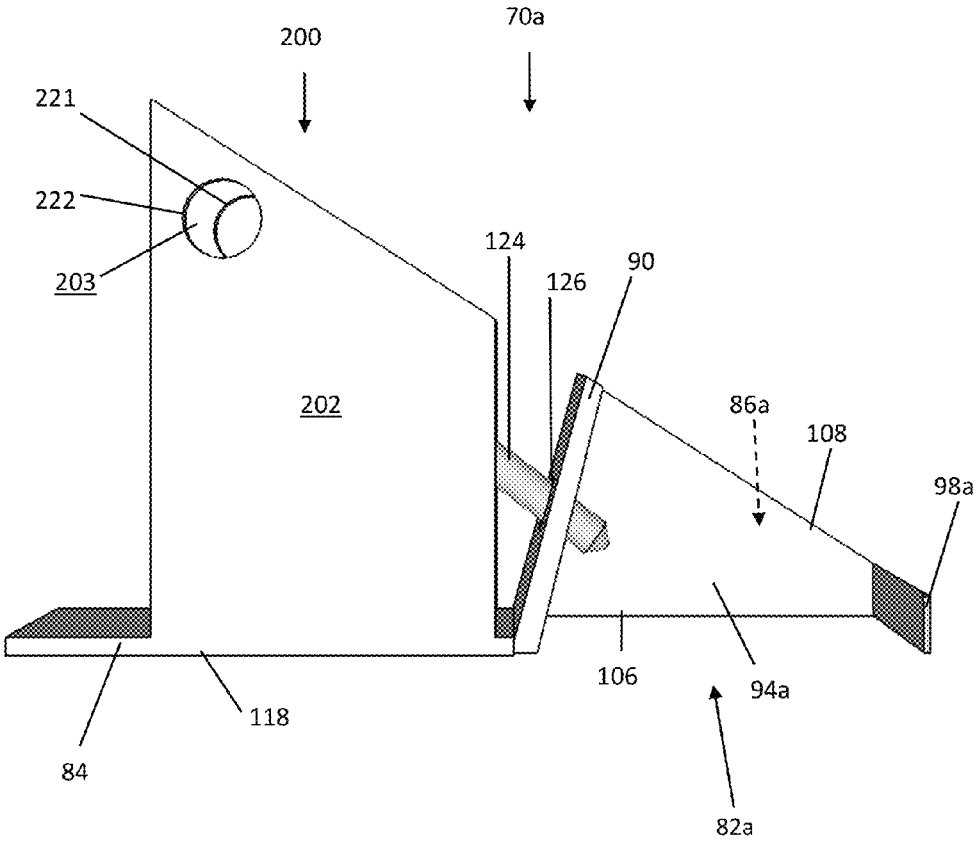
FIG. 6 is a side elevational view of another embodiment of the universal electrical circuit breaker lock device.
Figure 7:
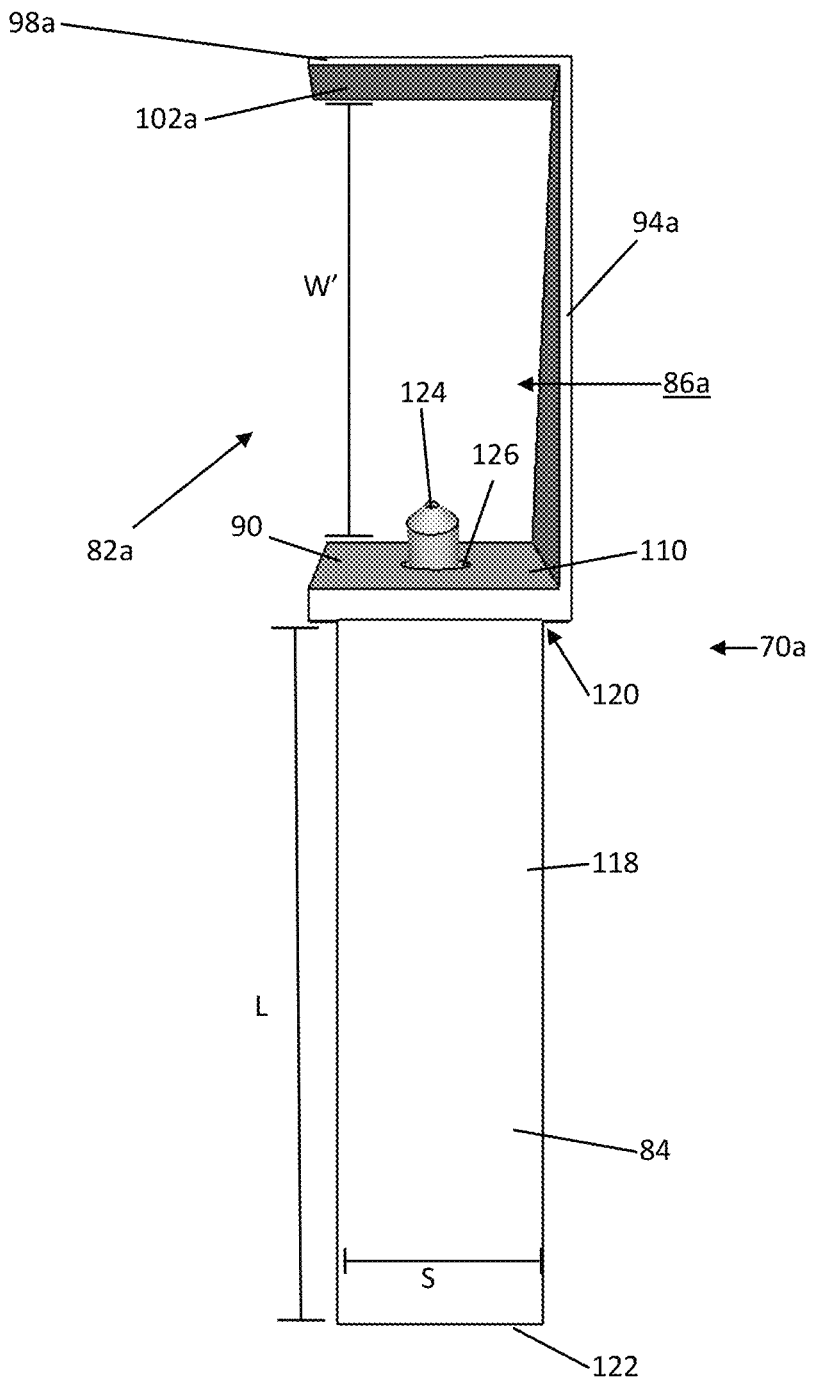
FIG. 7 is a top elevational view of the universal electrical circuit breaker lock device of FIG. 6.

Referring to FIGS. 6 and 7, in another embodiment of a universal breaker lock device 70*a*, all of one side face of the switch handle 76 is exposed, thereby allowing such an embodiment to be usefully employed with switch handles having any width that may extend through the uncovered portion of the switch handle. For example, as illustrated in FIGS. 6 and 7, the universal breaker lock device 70*a* includes a collar member 82*a* that defines a channel 86*a* and that does not cover or contact the switch handle 76 on its lateral surface 116 (See FIGS. 2 and 8) upon engagement with the switch handle 76. Once the universal breaker lock device 70*a* is secured to the switch handle 76 by means, for example, of fastener 124, then the switch handle 76 is impeded from switching from whichever position it was in to its opposite position. The universal breaker lock device 70*a* further includes a cover member 200, which is attached to the blocking member 84 and has open ends. The cover member 200 has side walls with outer surfaces 201, 202 and inner surfaces 203, 204. The cover member 200 also has top surface 205. In some embodiments, the cover member may further include a structure that facilitates addition of an external locking device, such as a keyed or combination lock, to the cover member to further limit access for removal of the breaker lock device. As illustrated in FIGS. 6 and 7, the cover member 200 further includes a pair of apertures 221, 222 disposed opposite each other. The apertures are disposed through the cover member side wall outer surfaces 201, 202 and inner surfaces 203, 204. The hasp of a lock of suitable size can be disposed through both apertures 220, 221. When the hasp of the lock (not pictured) is disposed through both apertures 220, 221, adjustment of the fastening means 124 is prevented. This serves to prevent accidental or intentional adjustments of the fastening means 124 resulting in an undesired removal of the universal breaker lock device 70*a*, thereby permitting an undesired change in the setting of the switch handle 76.

Referring to FIGS. 4 and 5, the channel 86 of the collar member 82 is defined by a base wall 90, first and second side walls 92, 94 that extend generally perpendicularly from the base wall 90, and first and second feet 96, 98 that extend toward one another from distal ends of the first and second side walls 92, 94, respectively. The channel 86 of the collar member 82 is dimensioned such that any conventional switch handle 76 may extend through the channel 86. In addition, gap 100 between distal ends of the first and second feet 96, 98 allows the channel 86 to be flexibly adjustable. When the universal breaker lock device 70 engages the switch handle 76, interior surfaces 102 of the first and second feet 96, 98 abut a surface 104 (See FIG. 2) of the switch handle 76.

Referring to FIG. 7, the channel 86*a* of the collar member 82*a* is defined by the base wall 90, a side wall 94*a* that extends generally perpendicularly from the base wall 90, and a top wall 98*a* that extends generally perpendicularly from a distal end of the side wall 94*a*.

Figure 3:
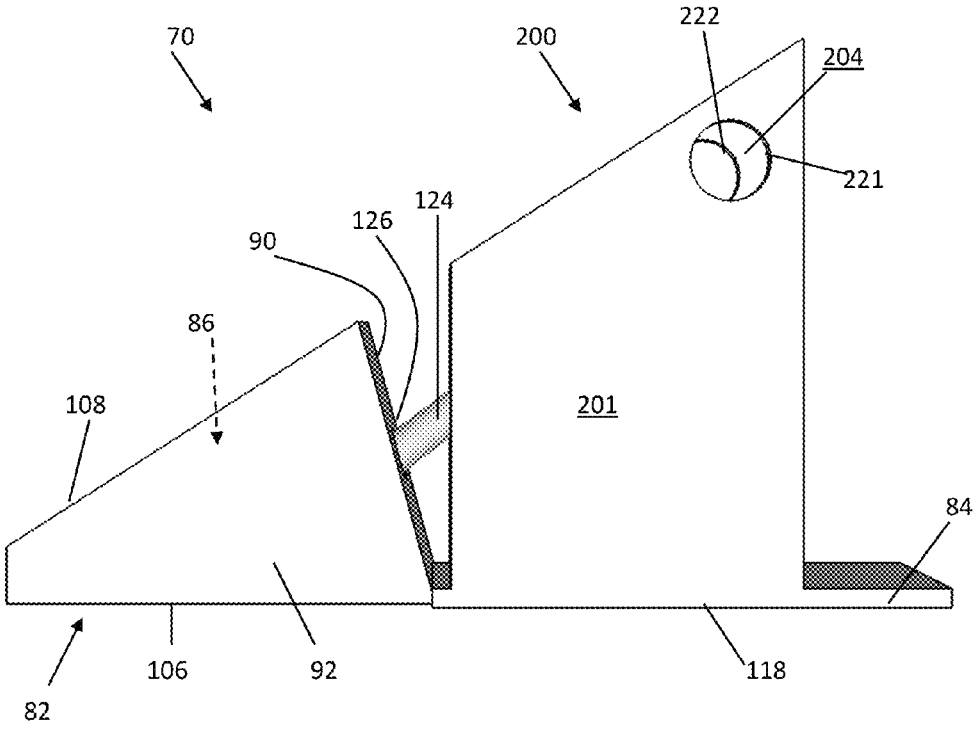
FIG. 3 is a side elevational view of the universal electrical circuit breaker lock device of FIG. 2.

The channel 86, 86*a* includes first and second ends 106, 108 that are each generally planar, as illustrated in FIGS. 3 and 6. In one embodiment, the blocking member 84 extends from the base wall 90 substantially parallel to the first end 106 of the channel 86, 86*a*.

The channel 86 of the collar member 82 may be dimensioned to form a press fit with the switch handle 76. For example, the surfaces 102 and an interior surface 110 of the base wall 90 of the collar member 82 may be in flush contact with the surfaces 104 and 88 of the switch handle 76, respectively, and/or interior surfaces 112, 114 of the side walls 92, 94 may be in flush contact with lateral surfaces 116 of the switch handle 76. Similarly, the channel 86*a* of the collar member 82*a* may be dimensioned to form a press fit with the switch handle 76 via flush contact between the surfaces 88 and 110 and between the surface 104 and an interior surface 102*a* of the top wall 98*a*.

Referring to FIGS. 2-7, the blocking member 84 includes a contact surface 118 that is adapted to make substantial contact with the switch panel 80 external to the aperture 78. Accordingly, the contact surface 118 may be substantially planar and may have any shape as desired, for example, rectangular as illustrated in FIGS. 4 and 6. The surface 118 is generally parallel to the switch panel 80 when the universal breaker lock device 70, 70*a* engages the electrical switch 72.

The blocking member 84 extends away from the collar member 82, 82*a* generally in the direction of motion of the switch handle 76 that the universal breaker lock device 70, 70*a* is configured to prevent. The blocking member 84 has a long dimension or length, L, measured between a proximal end 120 attached to the base wall 90 and a distal end 122 of the blocking member 84. The channel 86 has a greatest internal dimension measured transversely across the channel 86 between opposite internal surfaces thereof. For example, the greatest transverse internal dimension of the channel 86 may be a width, W, measured between the interior surfaces 112, 114 of the side walls 92, 94, as illustrated in FIGS. 4 and 5. Similarly, the channel 86*a* may, for example, have a greatest internal dimension, W', measured transversely across the channel 86*a* between the surface 110 and the interior surface 102*a* of the top wall 98*a*, as illustrated in FIG. 7.

The length L of the blocking member 84 is configured to be a length greater than the greatest transverse internal dimension W, W' of the channel 86, 86*a*, respectively. This configuration provides a blocking member sufficiently long to make contact with the switch panel 80 exterior to the aperture 78 so long as the channel 86, 86*a* fits over the switch handle 76. Furthermore, more contact between the blocking member 84 and the switch panel 80 may increase friction therebetween and prevent slippage of the universal breaker lock device 70, 70*a* relative to the electrical switch 72.

The blocking member 84 has a short dimension, S, measured transverse to the long dimension L. The short dimension, S, may be configured to be less than the greatest transverse internal dimension of the channel 86, 86*a*, as illustrated in FIGS. 4, 5, and 7. This configuration may be useful in application of multiple universal breaker lock devices 70, 70*a* to multiple electrical switches 72 that are arranged next to one another within a confined space.

In other embodiments, in addition to or instead of being configured substantially parallel to the first end 106, the blocking member 84 may form an angle with the first end 106. An angled blocking member 84 may be useful in some circumstances given the geometry and/or contours of the switch housing 74, which may vary between brands of electrical switches 72.

Not wishing to be bound by theory, the blocking member 84 acts as a lever arm that provides a reaction moment in response to rotational movement of the switch handle 76. Any force applied to move the switch handle 76 from the ON position to the OFF position (or vice versa depending on the configuration of the universal breaker lock device 70, 70*a* and switch handle 76) causes the switch panel 80 to produce an equal and opposite reaction force in the blocking member 84 that substantially eliminates movement of the switch handle 76. The blocking member 84 transfers this reaction force to the switch handle 76 via the collar member 82, 82*a*, which operatively grips the switch handle 76 when a force is applied to move the switch handle 76.

The interior surface 110 of the base wall 90 may contact the surface 88 of the switch handle 76. The interior surface 110 may be positionally adjustable such that an interior dimension measured between the interior surface 110 and surfaces 102, 102*a* may be altered to allow the collar member 82, 82*a* to be able to universally grip a variety of switch handles 76 having a variety of shapes and sizes.

Alternatively, an adjustable fastener 124, such as, for example, a set screw, may extend through a threaded aperture 126 disposed through the base wall 90 and impinge the surface 88 of the switch handle 76. The distance that the fastener 124 extends into the channel 86, 86*a* may be adjusted by rotating the fastener 124 through the threaded hole 126. The fastener 124 creates friction between the collar member 82, 82*a* and the switch handle 76 to increase the effectiveness of the grip there between. Additionally, the fastener 124 transfers the hereinabove described reaction force produced in the blocking member 84 to the surface 88 of the switch handle 76 thereby inhibiting movement of the switch handle 76.

Figure 9:
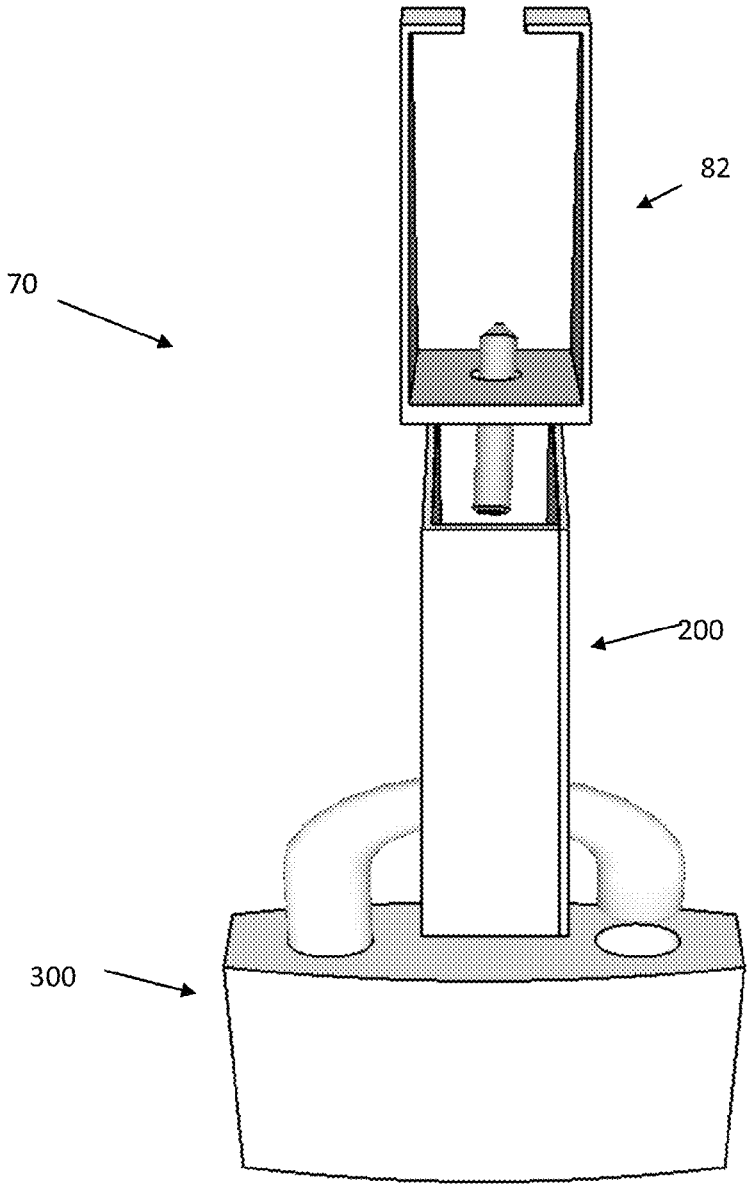
FIG. 9 is a top elevational view of the universal circuit breaker lock device of FIG. 2, engaged with a locking device.

The adjustability of the fastener 124 allows the universal breaker lock device 70, 70*a* to be operational with a multiplicity of available brands of electrical switches 72 having a switch handle 76 as large as the maximum size of the channel 86, 86*a*. The fastener 124 may be fixed in a predetermined position relative to the collar member 82, 82*a* by a locking mechanism as described in U.S. Pat. Nos. 5,079,390 and 5,147,991, which are hereby incorporated by reference in their entireties. FIG. 9 depicts another embodiment of the universal breaker lock device 70, where the hasp of a lock means 300 is engaged through the apertures of the cover means 200 to prevent intentional or unintentional adjustment to the fastener means. The lock means may be any lock means as known in the art, including padlocks, key locks, and/or the like, having a shaft or hasp that can pass through the apertures in the cover and be locked in place.

The adjustability of the universal breaker lock device 70, 70*a* not only allows for utility on a wide range of switch handle shapes and sizes but also allows a user to quickly and simply restrain an electrical switch from being actuated. This flexibility and ease of installation may save time in comparison to more complex devices intended only for tamper proof or more permanent installation. The universal breaker lock device 70, 70*a* described hereinabove may require less material to manufacture than known larger and bulkier breaker lock devices, thereby providing an economical benefit in cost of material. Further, the open nature of the second end 108 of the channel 86, 86*a* allows a user to see indicia such as brand, model, or amperage rating that may be printed or embossed on a distal end of the switch handle 76.

While the present invention may be embodied in many forms, multiple embodiments are discussed herein with the understanding that embodiments illustrated are to be considered only as an exemplification of the invention and are not intended to limit the disclosure to the embodiments illustrated. For example, although the universal breaker lock device 70, 70*a* is described hereinabove with regard to a circuit breaker switch, the universal restraint device 70, 70*a* is also operable with wall mounted light switches. Further, it should be understood that the universal breaker lock device 70, 70*a* is not limited to use with electrical switches. The universal breaker lock device 70, 70*a* can be dimensioned to operate with any manual switch adapted to be selectively displaced in an ON or OFF position. It should be understood that the universal breaker lock device 70, 70*a* can engage a switch in both an upright and inverted position to prevent downward and upward movement, respectively, of the switch handle 76.

INDUSTRIAL APPLICABILITY

A universal breaker lock device for a switch handle is presented that includes an adjustable collar member and a lever arm that is sized to be longer than a maximum internal transverse dimension of the collar member. The universal breaker lock device further comprises a cover member adapted to receive a locking element which prevents adjustment of the device while in use. The configuration and length of the lever arm and the adjustable size of the collar member allow the universal restraint device to be quickly and easily applied to a variety of switch handle shapes and sizes.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety

We claim:

1. A universal breaker lock device for a switch handle that projects through an aperture in a switch housing, the universal breaker lock device comprising:

a. a collar member forming a channel therethrough and adapted to engage the switch handle;

b. a blocking member extending from the collar member and configured to contact the switch housing external to the aperture when the collar member engages the switch handle; and c. a cover member immovably attached to the blocking member, with at least one aperture disposed therethrough.

2. The universal breaker lock device of claim 1, wherein a surface of the blocking member is substantially parallel to the switch housing external to the aperture when the collar member engages the switch handle.

3. The universal breaker lock device of claim 1, wherein the switch handle extends entirely through the channel of the collar member when the collar member engages the switch handle.

4. The universal breaker lock device of claim 1, wherein the blocking member has a long dimension greater than the greatest dimension measured transversely across the channel between opposite surfaces thereof.

5. The universal breaker lock device of claim 1, wherein the blocking member has a generally rectangular shape.

6. The universal breaker lock device of claim 1, wherein the channel is defined by a base wall, a side wall that extends generally perpendicularly from the base wall, and a top wall that extends generally perpendicularly from a distal end of the side wall, such that the ends of the top and base walls opposite the side wall have an open gap therebetween.

7. The universal breaker lock device of claim 1, wherein the blocking member has a short dimension less than the greatest dimension measured transversely across the channel between opposite interior surfaces thereof.

8. The universal breaker lock device of claim 1, wherein the cover member is adapted to receive a lock member disposed through the at least one aperture, such that insertion of the lock member through the at least one aperture prevents removal of the device from the switch handle, when the collar member is engaged with the switch handle.

9. A universal breaker lock device for a switch handle comprising:

a. a channel adapted to accommodate the switch handle and having first and second planar ends, wherein the channel comprises a base wall, a side wall that extends generally perpendicularly from the base wall, and a top wall that extends generally perpendicularly from a distal end of the side wall, such that the ends of the top and base walls opposite the side wall have an open gap therebetween;

b. a lever arm extending from the channel a distance greater than the greatest dimension measured transversely across the channel; and c. a cover member immovably attached to the lever arm, with at least one aperture disposed therethrough.

10. The universal breaker lock device of claim 9, wherein the cover member is adapted to receive a lock member disposed through the at least one aperture, such that engaging the lock member with the cover member prevents removal of the device from the switch handle, when the channel is engaged with the switch handle.

11. The universal breaker lock device of claim 9, wherein the universal breaker lock device is formed from a single continuous piece of material selected from the group consisting of steel, stainless steel, copper, aluminum alloy, polyethylene, polyvinyl chloride, and polypropylene.

12. A universal breaker lock device for a switch handle, comprising:

a. a channel adapted to accommodate the switch handle, wherein the channel includes a base wall, first and second side walls that extend generally perpendicularly from the base wall, and first and second feet that extend toward one another from distal ends of the first and second side walls, wherein the channel includes a width defined by a distance measured between the first and second side walls, wherein the first and second feet are not connected and define a gap therebetween;

b. a lever arm that extends from the base wall a distance greater than the width of the channel; and c. a cover member attached to the lever arm, with at least one aperture disposed therethrough.

13. The universal breaker lock device of claim 12, wherein first and second ends of the channel are generally planar.

14. The universal breaker lock device of claim 12, wherein a surface of the lever arm extends from the base wall substantially parallel to the first end of the channel.

15. The universal breaker lock device of claim 12 further comprising a threaded aperture disposed through the base wall.

16. The universal breaker lock device of claim 15 further comprising a set screw threadably engaged within the threaded aperture.

17. The universal breaker lock device of claim 16, further comprising a lock member insertable through the at least one aperture disposed through the cover member.

18. The universal breaker lock device of claim 17, wherein the insertion of the lock member through the at least one aperture prevents adjustment of the set screw.

19. The universal breaker lock device of claim 12, wherein the cover member is adapted to receive a lock member disposed through the at least one aperture.

20. The universal breaker lock device of claim 19, wherein engaging the lock member with the cover member prevents removal of the device from the switch handle, when the channel is engaged with the switch handle.

* * * * *